US008626038B2

(12) United States Patent
Nelson et al.

(10) Patent No.: US 8,626,038 B2
(45) Date of Patent: Jan. 7, 2014

(54) DEVELOPER UNIT AND METHOD THEREOF

(75) Inventors: Eric Nelson, San Diego, CA (US); David Vejtasa, Poway, CA (US); Alexander Karp, San Diego, CA (US); Christopher S Tanner, San Diego, CA (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 152 days.

(21) Appl. No.: 13/259,598

(22) PCT Filed: Jun. 8, 2009

(86) PCT No.: PCT/US2009/046584

§ 371 (c)(1),
(2), (4) Date: Sep. 23, 2011

(87) PCT Pub. No.: WO2010/144076

PCT Pub. Date: Dec. 16, 2010

(65) Prior Publication Data

US 2012/0027468 A1 Feb. 2, 2012

(51) Int. Cl.
*G03G 15/095* (2006.01)
*G03G 13/095* (2006.01)

(52) U.S. Cl.
USPC ..... 399/264

(58) Field of Classification Search
USPC ..... 399/249, 251, 348, 237
See application file for complete search history.

(56) References Cited

U.S. PATENT DOCUMENTS 4,462,677 A 7/1984 Onoda
5,061,959 A 10/1991 Kinoshita et al.
5,113,220 A 5/1992 Kwak
5,231,453 A 7/1993 Nakai et al.
5,353,098 A 10/1994 Lim (Continued)

FOREIGN PATENT DOCUMENTS

JP 07-301997 A 11/1995
JP 2001-242716 A 9/2001
JP 2002-174954 A 6/2002

OTHER PUBLICATIONS

International Search Report and Written Opinion received in PCT Application No. PCT/US2009/046584, mailed Sep. 1, 2009, pp. 10.

*Primary Examiner* — Clayton E Laballe
*Assistant Examiner* — Victor Verbitsky

(57) ABSTRACT

A developer unit usable with a liquid electrophotographic printing apparatus having a photosensitive drum includes a developer roller configured to receive ink, and to selectively engage and rotatably transfer the ink to the photosensitive drum, the developer roller configured to switch between a contact mode when the developer roller is rotating and a non-contact mode when the developer roller is not rotating, a squeegee roller selectively in contact with the developer roller, the squeegee roller configured to at least condense the received ink on the developer roller in the contact mode, and configured to be apart from the developer roller in the non-contact mode, and a cleaner roller selectively in contact with the developer roller, the cleaner roller configured to remove remaining ink from the developer roller not transferred to the photosensitive drum in the contact mode, and to be apart from the developer roller in the non-contact mode, wherein at least one of the squeegee roller, the cleaner roller and the developer roller are configured to move between the contact mode and the non-contact mode in response to a rotational state of the developer roller.

15 Claims, 7 Drawing Sheets

(56) References Cited

U.S. PATENT DOCUMENTS

| | | | | |
|---|---|---|---|---|
| 5,432,591 | A * | 7/1995 | Geleynse | 399/249 |
| 5,521,685 | A * | 5/1996 | Barnes et al. | 399/249 |
| 6,987,941 | B2 * | 1/2006 | Takeuchi et al. | 399/237 |
| 7,389,070 | B2 | 6/2008 | Onishi | |
| 2006/0165433 | A1 | 7/2006 | Mercer et al. | |
| 2006/0165434 | A1 | 7/2006 | Kim et al. | |

* cited by examiner

DEVELOPER UNIT AND METHOD THEREOF

BACKGROUND

A developer unit such as a binary ink developer (BID) unit is a consumable that is often used in a printing apparatus such as a liquid electrophotographic (LEP) printing apparatus. This consumable is generally made from custom and/or off-the-shelf components. In LEP printing apparatus, generally a photosensitive drum is charged and is then selectively exposed to a laser to form a charge pattern that corresponds to an image. The drum is then contacted with a BID unit that selectively transfers a liquid ink pattern to the charge pattern. The liquid ink pattern is transferred from the photosensitive drum to a print medium, for example, through an intermediate member, to form the image on the print medium.

BRIEF DESCRIPTION OF THE DRAWINGS

Exemplary non-limiting embodiments of the present general inventive concept are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

During the life of a development unit such as a binary ink developer (BID) unit there are many occurrences when the BID unit is stopped, for example, between print jobs. During such occurrences a developer roller of the BID unit may sustain damage to a portion thereof exposed to extended contact with adjacent components resulting in potential mechanical, chemical and electrical damage to the developer roller. Further, a developer roller may have a portion thereof exposed to a stable environment inside the developer unit and another portion thereof exposed to a different environment outside of the developer unit when the developer roller, for example, is not rotating and is not engaged with a photosensitive drum. Thus, the portion exposed to the outside environment may be subjected to damage caused by polymer conductivity and polymer surface properties. The damage to the developer roller may result in banding which negatively impacts print quality.

Figure 1:
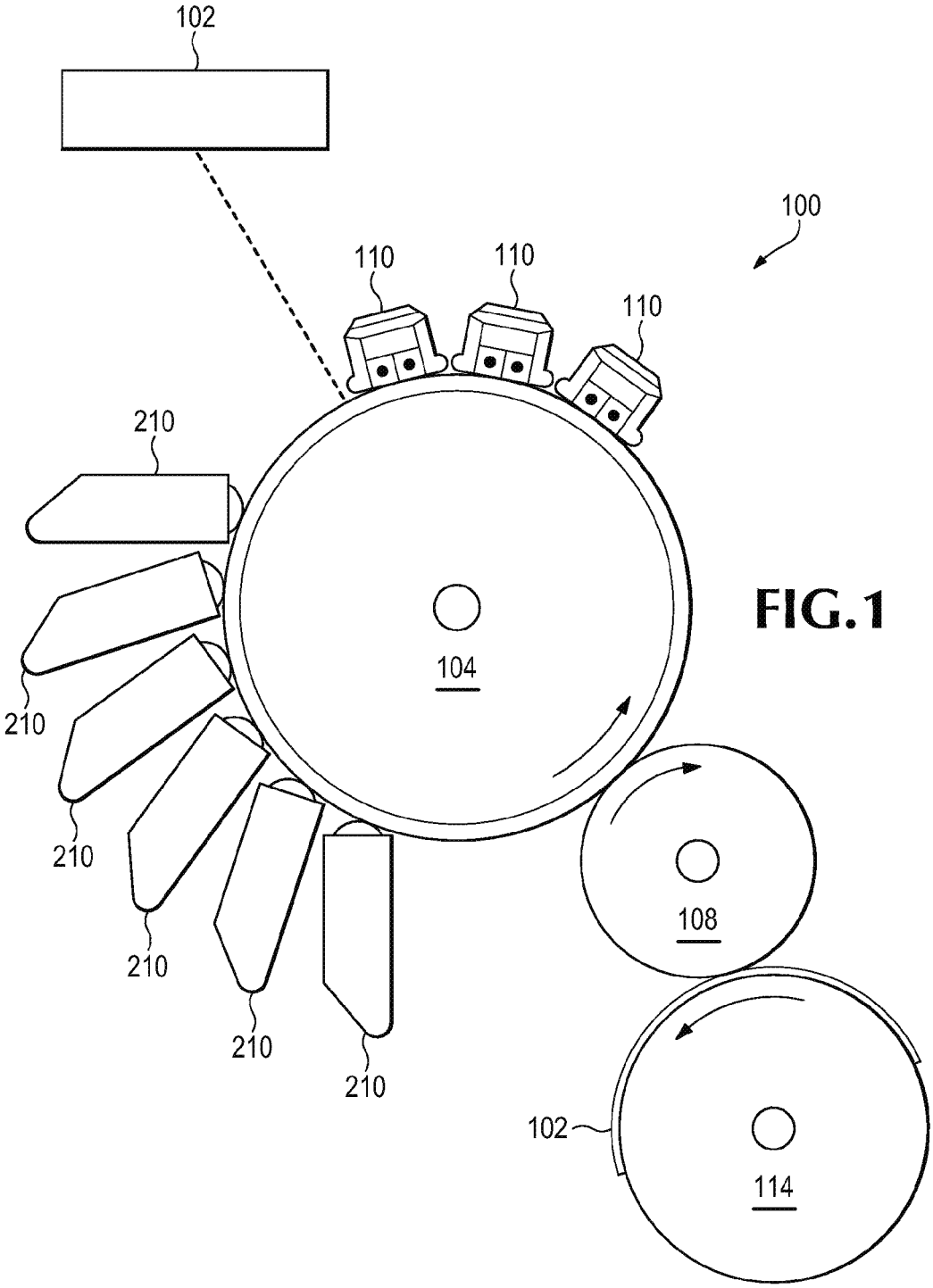
FIG. 1 is a simplified view of developer units disposed in a liquid electrophotographic printing apparatus according to an embodiment of the present general inventive concept.

FIG. 1 is a simplified view of developer units disposed in a liquid electrophotographic (LEP) printing apparatus according to an embodiment of the present general inventive concept. Referring to FIG. 1, the LEP printing apparatus 100 includes a light source 102, a photosensitive drum 104, charge units 110, an intermediate transfer member 108 and an impression drum 114. Also, illustrated in FIG. 1 are developer units 210 removeably mounted in the LEP printing apparatus 100 opposite the photosensitive drum 104.

In one embodiment, the photosensitive drum 104 may include a photo imaging plate (PIP) foil having a cylindrical photoconductive material made of selenium, a selenium compound, an organic photoconductor or any other suitable photoconductor known to one of ordinary skill in the art disposed around a drum core. The charge units 110 may be any type of charge unit known to one of ordinary skill in the art, such as a scorotron or a charge roller. The intermediate transfer member 108 may include a roller having a cylindrical blanket disposed around a drum core.

In the present embodiment, as illustrated in FIG. 1, the intermediate transfer member 108 may be disposed between and in contact with the photosensitive drum 104 and the impression drum 114. The charge units 110 and the developer units 210 may be circumferentially arranged proximate to the photosensitive drum 104. The developer units 210 may selectively engage the photosensitive drum 104 as is old and well-known to one of ordinary skill in the art. The developer units 210 may be, for example, binary ink development units (BID). In the present embodiment, each BID unit 210 may include ink such as liquid toner, and contain a different color ink. For example, the six BID units 210 illustrated in FIG. 1 may contain a total of six different color inks.

According to an exemplary embodiment, in operation, the LEP printing apparatus 100 may produce a print on a substrate 102 as illustrated in FIG. 1 as follows. The photosensitive drum 104 is charged by the charge units 110. As the photosensitive drum 104 is rotated, the light source 102 such as a laser produces a laser beam that discharges specific areas on the photosensitive drum 104. These discharged areas define a latent image. One BID unit 210, for example, selectively engages the photosensitive drum 104 and applies the ink thereto during each rotation of the photosensitive drum 104.

In the present embodiment, the BID unit 210 includes a developer roller 214 (FIG. 2A) which, for example, may be charged to a lower potential than the charged areas on the photosensitive drum 104, and a larger potential than the discharged areas on the photosensitive drum 104. Charged ink in the BID unit 210 is attracted to the discharged areas on the photosensitive drum 104 and not transferred to areas of the photosensitive drum 104 having higher potential than the developer roller 214. Thus, as the photosensitive drum 104 is rotated, a color plane of the image is formed on the photosensitive drum 104. With each additional rotation of the photosensitive drum 104, for example, the laser discharges specific areas on the photosensitive drum 104 and another BID unit 210 selectively engages the photosensitive drum 104 and applies ink to the discharged areas. In this manner, a developed image is formed on the photosensitive drum 104. The charging of the developer roller 214, the photosensitive drum 104, and the ink is old and well-known to one of ordinary skill in the art. Also, the arrows inside each roller indicate the exemplary rotational direction of the respective rollers. It is envisioned that the rollers may rotate in other suitable directions.

In the present embodiment, the developed image is transferred from the photosensitive drum 104 to the intermediate transfer member 108. The transfer of the developed image is achieved, for example, through predominantly electrical and/or mechanical forces. The intermediate transfer member 108 may be charged and heated to raise a temperature of the ink, for example, to drive off carrier fluid and melt ink for fixing on the substrate 102. The developed image is transferred from the intermediate transfer member 108 to the substrate 102 such as a print medium passing between the intermediate transfer member 108 and the impression drum 114.

Figure 2A:
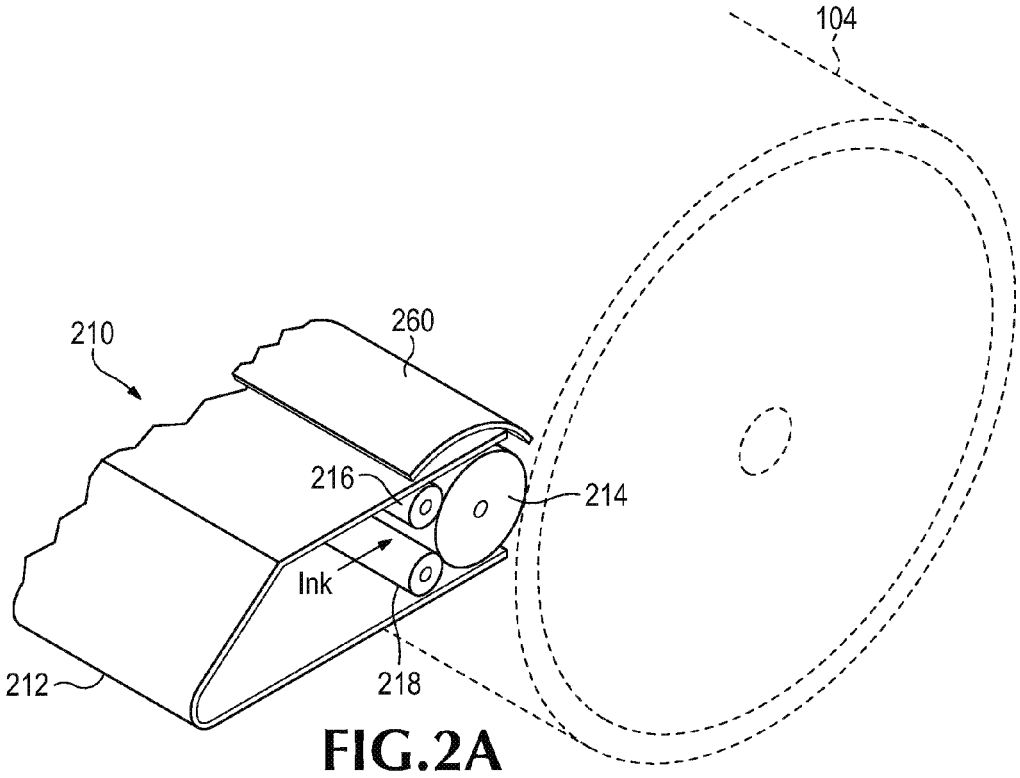
FIGS. 2A and 2B are cross-sectional perspective views of a developer unit in a contact mode/uncover position and a non-contact mode/cover position, respectively, according to an embodiment of the present general inventive concept.
Figure 2B:
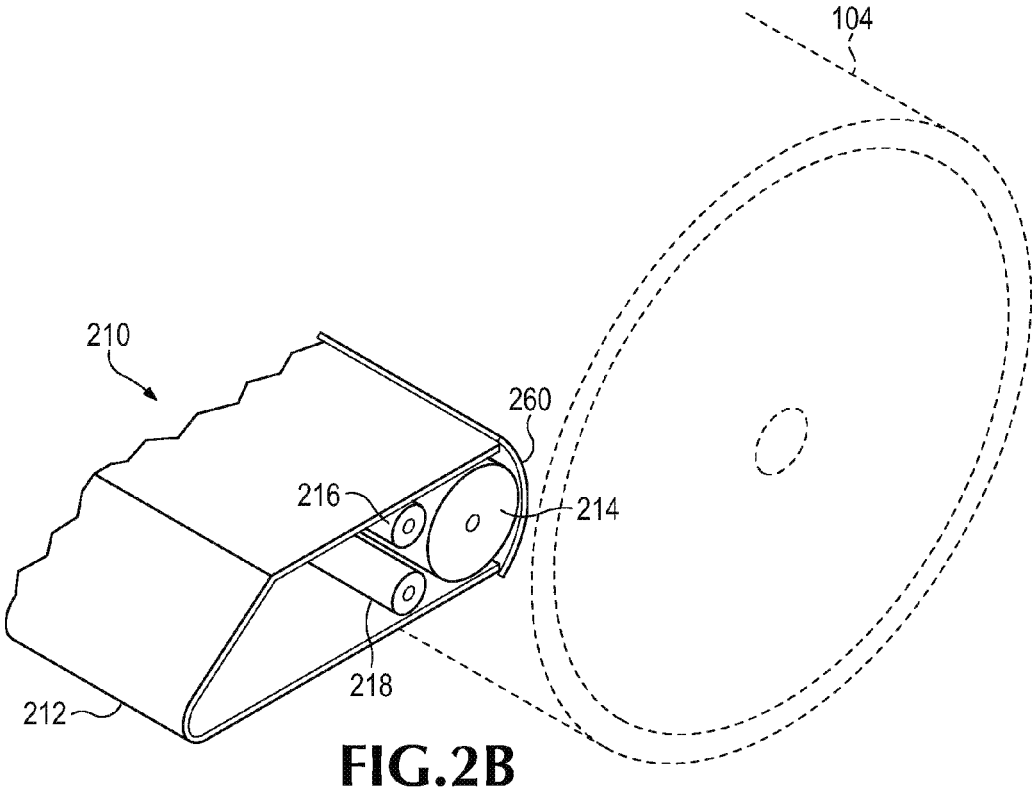

FIG. 2A is a cross-sectional perspective view of a developer unit in a contact mode and uncover position according to an embodiment of the present general inventive concept. FIG. 2B is a cross-sectional perspective view of a developer unit in a non-contact mode and cover position according to an embodiment of the present general inventive concept. Referring to FIGS. 2A and 2B, in the present embodiment, the developer unit 210 is selectively engaged with a photosensitive drum 104 (illustrated in phantom) of LEP printing apparatus 100 (FIG. 1). The developer unit 210 may include a developer roller 214, a squeegee roller 216, a cleaner roller 218, a housing 212, and a cap member 260. The housing 212 may be removably mounted to the LEP printing apparatus 100 (FIG. 1). At least one of the developer roller 214, the squeegee roller 216, the cleaner roller 218 and the cap member 260 are moveably coupled to the housing 212. In one embodiment, the developer roller 214 is moveably coupled to the housing 212. In another embodiment, the squeegee roller 216 and the cleaner roller 218 are moveably coupled to the housing 212. In yet another embodiment, each of the developer roller 214, the squeegee roller 216, the cleaner roller 218 and the cap member 260 are moveably coupled to the housing 212.

In one embodiment, the developer roller 214 may include a shaft having two ends opposite each other and extending outward from the developer roller 214. In other embodiments, the developer roller 214 may include a conductive core made of any conductive material, examples of which include metal, plastic with at least one conductive layer/material thereon and/or therein, and the like. For example, the core may be formed from one or more of aluminum, stainless steel, cold drawn steels with a coating thereon, and/or the like, and/or combinations thereof. In one embodiment, the core may also be covered with a layer of a conductive polymeric material, an example of which are polymeric materials incorporating additives such as metal particles, ionic charged particles, carbon black, graphite, and/or the like, and/or combinations thereof. In an embodiment, the layer is formed from a conductive urethane material. In one embodiment, the squeegee roller 216 may include an aluminum core which is anodized and coated with a layer of polyurethane.

In the present embodiment, the developer roller 214 is configured to receive the ink such to selectively engage and rotatably transfer the ink to the photosensitive drum 104. The developer roller 214 is configured to switch between a contact mode, as illustrated in FIG. 2A, when the developer roller 214 is in an active rotational state (e.g., the developer roller 214 is rotating) and a non-contact mode, as illustrated in FIG. 2B, when the developer roller 214 is in an inactive rotational state (e.g., the developer roller 214 is not rotating). The rotational state of the developer roller 214 may be determined, for example, from signals that are old and well-known to one of ordinary skill in the art used to stop and start rotation of rollers 214, 216, and 218 of the development unit 210, or any other conventional devices or operations to determine the rotational state of the development roller 214. For example, the respective signals may be initiated from the printing apparatus 100 such as from a main controller of the printing apparatus 100 driving the developer unit 210. Accordingly, in the present embodiment, the solenoids 355 (FIG. 3) may be, for example, electrically connected to and be activated and/or inactivated based on the respective signals. The squeegee roller 216 is selectively in contact with the developer roller 214 and is configured to at least condense the received ink on the developer roller 214 in the contact mode, as illustrated in FIG. 2A. The squeegee roller 216 is configured to be apart from the developer roller 214 in the non-contact mode, as illustrated in FIG. 2B. The cleaner roller 218 is selectively in contact with the developer roller 214 and is configured to remove remaining ink from the developer roller 214 not transferred to the photosensitive drum 104 in the contact mode, as illustrated in FIG. 2A. The cleaner roller 218 is configured to be apart from the developer roller 214 in the non-contact mode, as illustrated in FIG. 2B.

In the present embodiment, at least one of the squeegee roller 216, the cleaner roller 218 and the developer roller 214 are configured to move between the contact mode and the non-contact mode in response to a rotational state of the developer roller 214. In one embodiment, the squeegee roller 216 and the cleaner roller 218 move toward and away from the developer roller 214 in response to the rotational state of the developer roller 214. In another embodiment, the developer roller 214 moves toward and away from the squeegee roller 216 and the cleaner roller 218 in response to the rotational state of the developer roller 214.

Referring to FIGS. 2A and 2B, the cap member 260 is configured to move between a cover position (FIG. 2B) in which the cap member 260 covers an exposed portion of the developer roller 214 opposite the photosensitive drum 104 and an uncover position (FIG. 2A) in which the cap member 260 uncovers the exposed portion of the developer roller 214. The cap member 260 is configured to move between the cover position and the uncover position in response to the rotational state of the developer roller 214. That is, the cap member 260 is in the uncover position when the rotational state of the developer roller 214 is active and the cap member 260 is in the cover position when the rotational state of the developer roller 214 is inactive. In one embodiment, the squeegee roller 216, the cleaner roller 218 and the cap member 260 simultaneously move between the contact mode and the non-contact mode in response to the rotational state of the developer roller 214. In another embodiment, the developer roller 214 and the cap member 260 simultaneously move between the contact mode and the non-contact mode in response to the rotational state of the developer roller 214. An ink supply (not illustrated) to supply ink to the respective bid to be directed onto the developer roller 214 is old and well-known to one of ordinary skill in the art.

Figure 3:
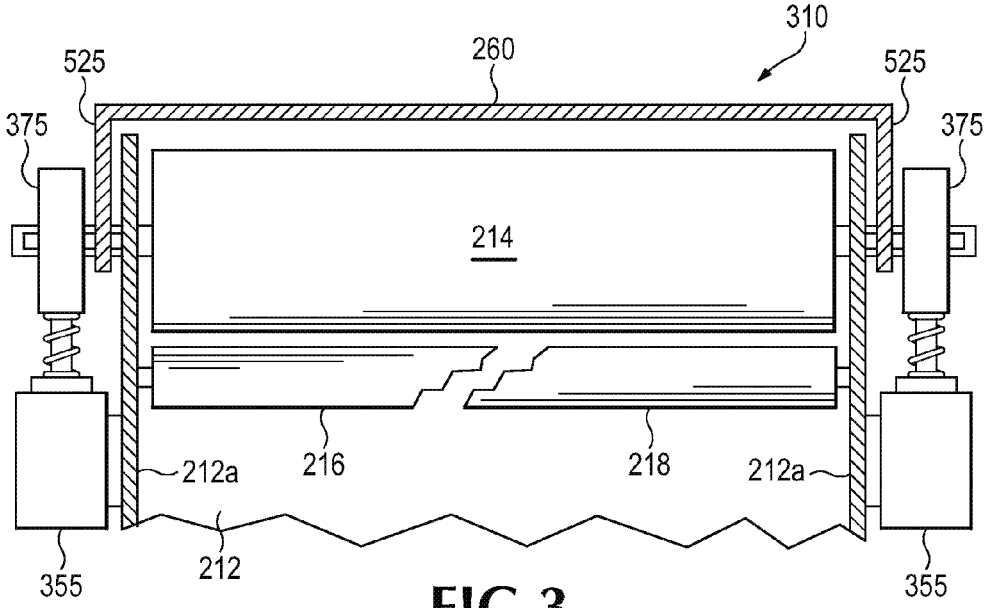
FIG. 3 is a front view of a developer unit in a non-contact mode/cover position according to an embodiment of the present general inventive concept.

FIG. 3 is a front view illustrating a developer unit in a non-contact mode and a cover position according to an embodiment of the present general inventive concept. Referring to FIG. 3, the developer unit such as a BID unit 310 may include a developer roller 214 including a shaft having two ends extending outward from the developer roller 214, a squeegee roller 216, a cleaner roller 218 a housing 212 including two endcap portions 212*a* at opposite ends from each other, a cap member 260 including two cap member linkage portions 525 on opposite ends of the cap member 260, two solenoids 355 each having a fixed portion and a movable portion, and a two movable endcap members 375. In the present embodiment, the moveable endcap member 375 couples the moveable portion of the solenoid 355 with an end of the shaft of the developer roller 214. The fixed portions of the solenoids 355 are mounted to the endcap portions 212*a* of the housing 212 of the BID unit 310. The cap member linkage portions 525 are coupled proximate to the ends of the shaft of the developer roller 214, respectively. Accordingly, in the present embodiment, when the solenoids 355 are inactivated its moveable portion moves away (e.g., a forward direction) from its fixed portion and the development roller 214 enters into a non-contact mode by moving away from the squeegee roller 216 and the cleaner roller 218, as illustrated in FIG. 3. In addition, the cap member 260 switches to a cover position as the cap member linkage portions 525 are coupled to the shaft of the developer roller 214 and moves along with the moveable portion of the solenoids 355. It is envisioned that the number of moveable endcaps and solenoids may vary as necessary.

In the present embodiment, the solenoids 355 are inactivated when the rotational state of the developer roller 214 is inactive. Alternatively, when the solenoids 355 are activated its moveable portion moves toward (e.g., a reverse direction) its fixed portion and the development roller 214 enters into a contact mode by moving toward and contacting the squeegee roller 216 and the cleaner roller 218. In addition, the cap member 260 switches to an uncover position as the cap member linkage portions 525 are coupled to the shaft of the developer roller 214 and moves along with the moveable portion of the solenoids 355 in the activated state.

In the present embodiment, the solenoids 355 are activated when the rotational state of the developer roller 214 is active. Although the present embodiment illustrates the movement of the moveable portion of the solenoid 355 toward its fixed portion upon activation and away from its fixed portion upon inactivation, it is also within the scope of the present general inventive concept to reverse the directions of the moveable portions of the solenoids relative to the fixed portions.

Figure 4A:
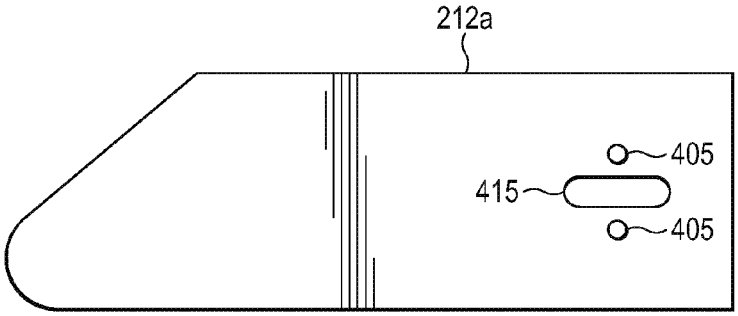
FIG. 4A is a side view illustrating a respective endcap portion of a housing of a BID unit of FIG. 3 according to an embodiment of the present general inventive concept.
Figure 4B:
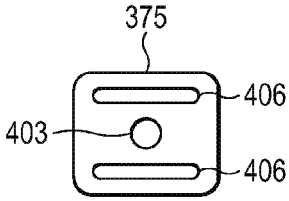
FIG. 4B is a side view illustrating a respective moveable endcap member of a housing of a BID unit of FIG. 3 according to an embodiment of the present general inventive concept.

FIG. 4A is a side view illustrating a respective endcap portion of a housing of a BID unit of FIG. 3 according to an embodiment of the present general inventive concept. FIG. 4B is a side view illustrating a respective movable endcap member of FIG. 3 according to an embodiment of the present general inventive concept. Referring to FIGS. 4A and 4B, in the present embodiment, the endcap portion 212*a* includes two pins 405 and a shaft receiving elongated opening 415. A size of the shaft receiving elongated opening 415 may be greater than a diameter of the respective end of the shaft of the developer roller 214 and may be disposed between the two pins 405. In the present embodiment, the moveable endcap member 375 may include two pin receiving elongated openings 406 and a shaft receiving opening 403. A size of the pin receiving elongated openings 406 are larger than a diameter of the pins 405 of the respective endcap portion 212*a* and a diameter of the shaft receiving opening 403 approximately corresponds to the diameter of the respective end of the shaft of the developer roller 214.

In the present embodiment, the pins 405 of the respective endcap portion 212*a* extend through the corresponding pin receiving elongated openings 406 of the moveable endcap member 375 and the shaft receiving elongated opening 415 of the endcap portion 212*a* aligns with the shaft receiving opening 403 of the moveable endcap member 375 to receive the respective end of the shaft of the developer roller 214 to extend therethrough. In other embodiments, the number of pins 405 and openings 403, 406 and 415 necessary in order to provide a moveably coupled developer roller 214 to the housing 212 may vary. Also, in other embodiments, the moveable endcap 375 may be integral to the respective end of the shaft of the developer roller 214 or the moveable portion of the solenoid 355 (FIG. 3).

Figure 5A:
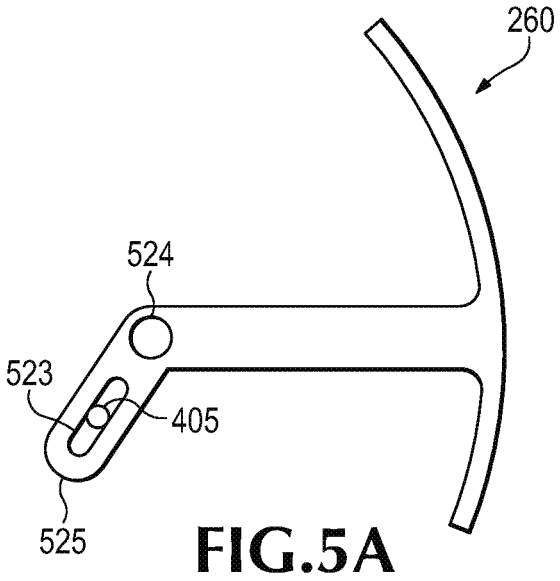
FIGS. 5A and 5B are exploded views of a respective cap member linkage portion of FIG. 3 in a cover position and uncover position, respectively, according to an embodiment of the present general inventive concept.
Figure 5B:
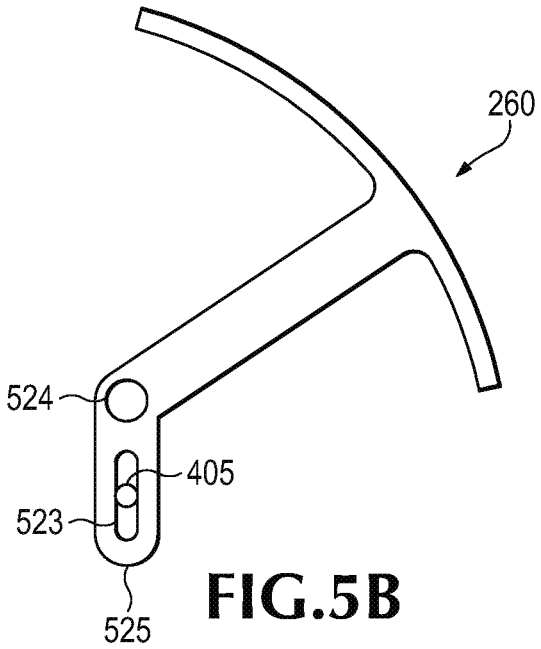

FIG. 5A is an exploded view of a respective cap member linkage portion of FIG. 3 in a cover position according to an embodiment of the present general inventive concept. FIG. 5B is an exploded view of the cap member linkage portion of FIG. 3 in an uncover position according to an embodiment of the present general inventive concept. Referring to FIGS. 4A-5B, in the present embodiment, the cap member linkage portion 525 may include a shaft receiving hole 524 and a pin receiving elongated hole 523. A size of the pin receiving elongated hole 523 is larger than a diameter of the corresponding pin 405 and a diameter of the shaft receiving hole 524 approximately corresponds to the diameter of the respective end of the shaft of the developer roller 214. In the present embodiment, the corresponding pin 405 extends through the pin receiving elongated hole 523 of the cap member linkage portion 525. Also, the shaft receiving elongated hole 524 of the cap member linkage portion 525 aligns with the shaft receiving elongated opening 415 of the endcap portion 212*a* and the shaft receiving opening 403 of the moveable endcap member 375 to receive the respective end of the shaft of the developer roller 214 which extends therethrough. In other embodiments, the number of holes 523 and 524 may vary as necessary in order to provide a moveably coupled developer roller 214 to the housing 212.

Referring to FIGS. 3, 5A and 5B, when the solenoid (FIG. 3) is inactivated and its moveable portion moves away from its fixed portion, the cap member 260 is placed into a cover position by rotating about the respective pin 405 inserted in the pin receiving elongated hole 523 in a clockwise direction to cover the exposed portion of the developer roller 214. Alternatively, when the solenoid 355 is activated and its moveable portion moves toward its fixed portion, the cap member 260 is placed in an uncover position by rotating about the respective pin 405 inserted in the pin receiving elongated hole 523 in a counterclockwise direction to expose an exposed portion of the developer roller 214, for example to allow contact with the photosensitive drum 104.

Figure 6A:
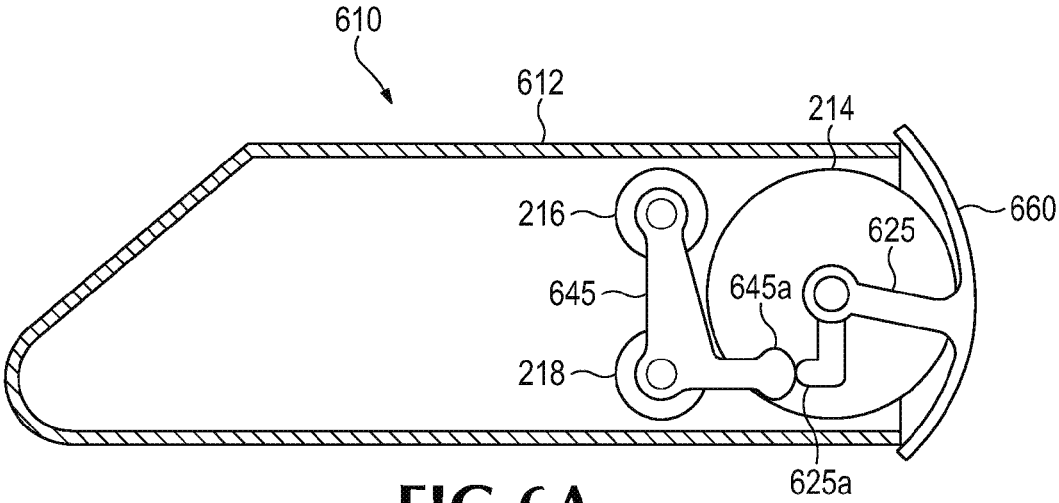
FIGS. 6A and 6B are side views of a BID unit in a non-contact mode/cover position and contact mode/uncover position, respectively, according to an embodiment of the present general inventive concept.
Figure 6B:
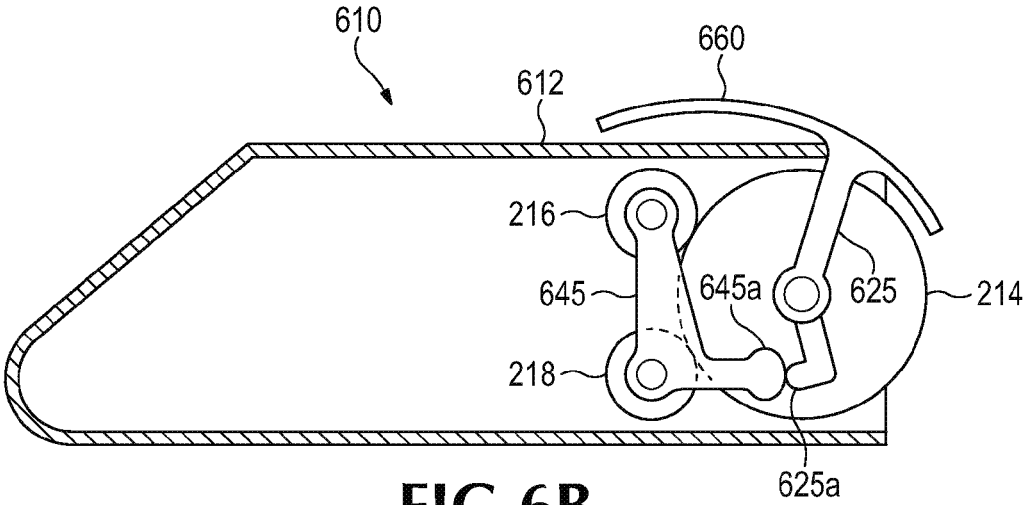

FIG. 6A is a side view of a BID unit in a non-contact mode and a cover position according to an embodiment of the present general inventive concept. FIG. 6B is a side view of a BID unit in a contact mode and an uncover position according to an embodiment of the present general inventive concept. Referring to FIGS. 6A and 6B, in the present embodiment, the BID unit 610 may include a housing 612, a developer roller 214, a squeegee roller 216, a cleaner roller 218, a linkage unit 645 to connect each of the squeegee roller 216 and the cleaner roller 218 to the housing 612, a cap member 660 including two cap member linkage portions 625 at opposite ends of the cap member 660. The cap member linkage portions 625 may include contact portions 625*a*, respectively. In the present embodiment, each of the contact portions 625*a* may form an angle with the cap member linkage portions 625, respectively, in which, for example, the cap member linkage portions 625 rotate about the shaft of the developer roller 214 with respect to the contact portions 625*a*. The housing 612 may be removably mounted to the LEP printing apparatus 100 (FIG. 1).

In the present embodiment, the developer roller 214 is moveably coupled to the housing 612 and the cap member 660 is moveably coupled to the developer roller 214. Accordingly, in response to the inactive rotational state of the developer roller 214, the developer roller 214 moves away from the squeegee roller 216 and the cleaner roller 218 in a forward direction, for example, by the ends of the shaft of the developer roller 214 being moved by solenoids 355 in a manner as previously described with respect to the developer roller 214 illustrated in FIG. 3. The cap member 660 rotates, for example, in a clockwise direction to cover an exposed portion of the developer roller 214 as the contact portions 625*a* and the cap member engagement portions 645*a* remain in contact with each other. Thus, placing the cap member 660 in a cover position.

Alternatively, in the present embodiment, in response to the active rotational state of the developer roller 214, the developer roller 214 moves toward and in contact with the squeegee roller 216 and the cleaner roller 218 in a reverse direction, for example, by the ends of the shaft of the developer roller 214 being moved by solenoids 355 in a manner as previously described with respect to the developer roller 214 illustrated in FIG. 3. The cap member 660 rotates, for example, in a counterclockwise direction to uncover an exposed portion of the developer roller 214 as the cap member engagement portions 645*a* and the contact portions 625*a* remain in contact with each other. Thus, placing the cap member 660 in an uncover position and the developer roller 214 can engage the photosensitive drum 104.

In another embodiment, the squeegee roller 216 and the cleaner roller 218 are moveably coupled to the housing 612. For example, the squeegee roller 216 and/or the cleaner roller 218 each may include a shaft having opposite ends similar to the shaft previously described with respect to the developer roller 214 with reference to FIG. 3. In this embodiment, the housing 612 may include endcap portions as described with reference to the housing 212 of FIG. 3. The BID unit 610 may also include moveable endcap members and solenoids to correspond with the ends of the shaft of the squeegee roller 216 and/or the cleaner roller 218 as previously described with respect to the developer roller 214 of FIG. 3. In this embodiment, the linkage unit 645 connects the squeegee roller 216 to the cleaner roller 218 to allow them, for example, to move together and includes a cap member engagement portion 645*a* to engage the contact portion 625*a* of the cap member linkage portion 625.

In this embodiment, in response to the active rotational state of the developer roller 214, the squeegee roller 216, the cleaner roller 218, and the linkage unit 645 move in a forward direction, for example, by the ends of the shaft of at least one of the squeegee roller 216 and the cleaner roller 218 being moved by solenoids in a manner similar to that previously described with respect to the developer roller 214 illustrated in FIG. 3. In this embodiment, the cap member engagement portions 645*a* and the contact portions 625*a* may be fixed with respect to each other and both rotate about of the shaft of the developer roller 214. Accordingly, the cap member engagement portion 645 pushes the contact portions 625*a* of the cap member linkage portions 625 in the forward direction and the cap member 660 rotates, for example, in a counterclockwise direction to uncover an exposed portion of the developer roller 214. Thus, placing the cap member 660 in an uncover position and the developer roller 214 can engage the photosensitive drum 104.

Alternatively, in this embodiment, in response to the inactive rotational state of the developer roller 214, the squeegee roller 216, the cleaner roller 218, and the linkage unit 645 move in a reverse direction, for example, by the ends of the shaft of at least one of the squeegee roller 216 and the cleaner roller 218 being moved by solenoids in a manner previously described with respect to the developer roller 214 illustrated in FIG. 3. Accordingly, the cap member engagement portions 645*a* move in a reverse direction and allow the cap member 660 to rotate, for example, in a clockwise direction to cover an exposed portion of the developer roller 214 as the contact portions 625*a* and the cap member linkage portions 625 remain in contact with each other. Thus, placing the cap member 660 in a cover position.

Figure 7:
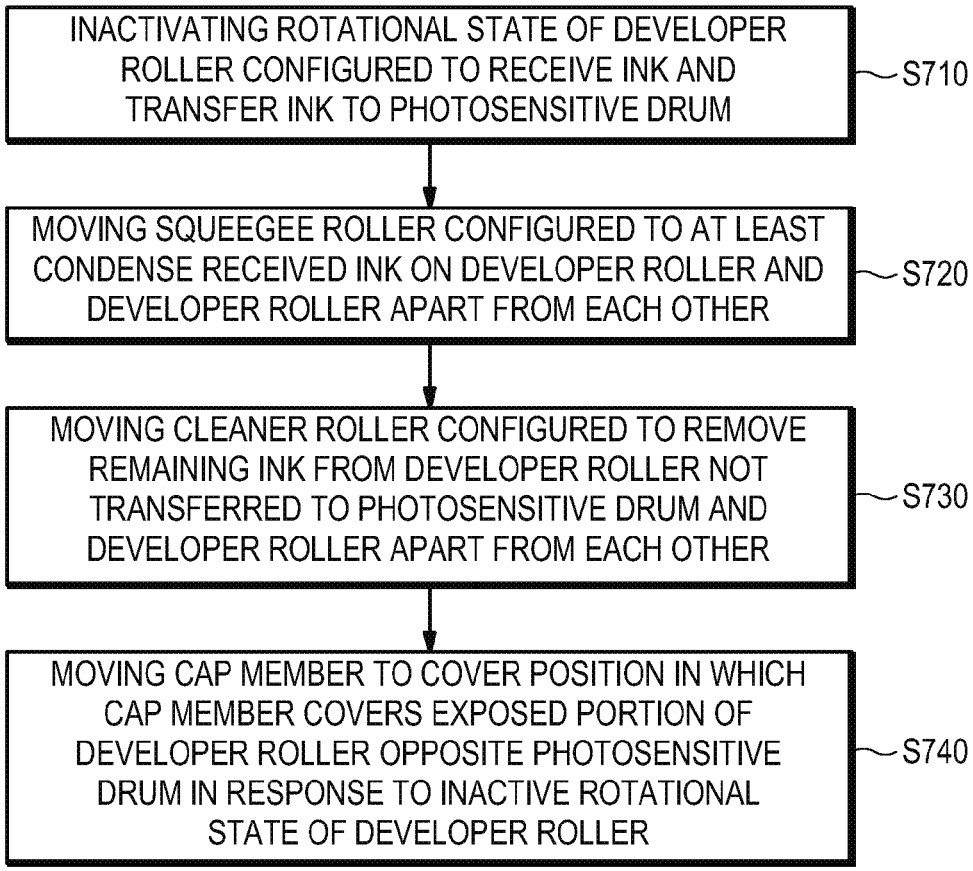
FIG. 7 is a flowchart illustrating a method of operating a developer unit usable with a liquid electrophotographic printing apparatus having a photosensitive drum according to an embodiment of the present general inventive concept.

FIG. 7 is a flowchart illustrating a method of operating a developer unit usable with a liquid electrophotographic printing apparatus having a photosensitive drum. Referring to FIG. 7, in operation S710, a rotational state of a developer roller configured to receive ink and transfer the ink to the photosensitive drum is inactivated. In operation S720, a squeegee roller configured to at least condense the received ink on the developer roller and the developer roller are moved apart from each other. In operation S730, a cleaner roller configured to remove remaining ink from the developer roller not transferred to the photosensitive drum and the developer roller are moved apart from each other. In operation S740, a cap member is moved to a cover position in which the cap member covers an exposed portion of the developer roller opposite the photosensitive drum in response to the inactive rotational state of the developer roller. Thus, the develop roller is prevented from being adversely impacted by external elements.

Figure 8:
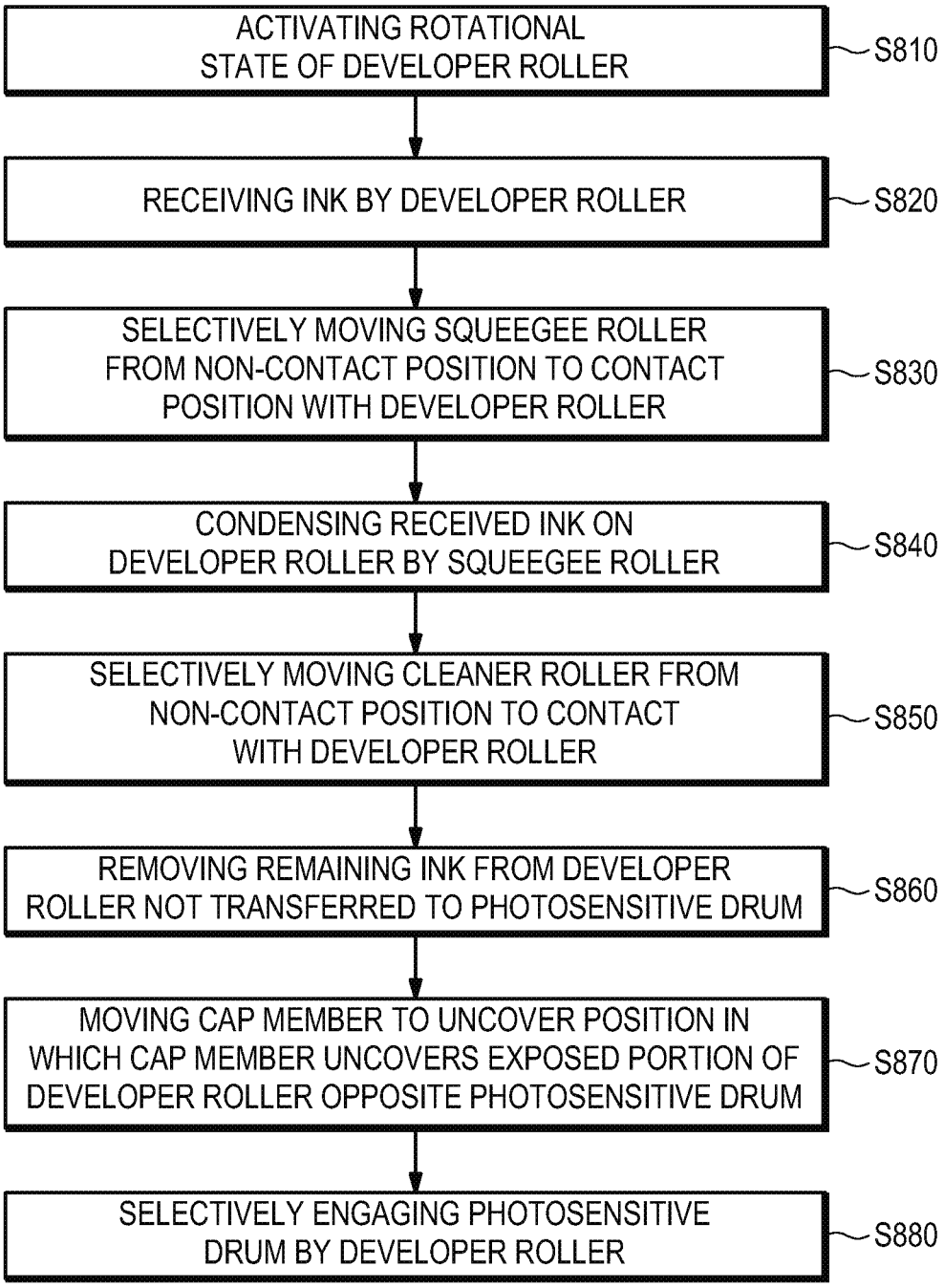
FIG. 8 is a flowchart illustrating a method of operating a developer unit usable with a liquid electrophotographic printing apparatus having a photosensitive drum according to an embodiment of the present general inventive concept.

FIG. 8 is a flowchart illustrating a method of operating a developer unit usable with a liquid electrophotographic printing apparatus having a photosensitive drum. Referring to FIG. 8, in operation S810, a rotational state of a developer roller is activated. In operation S820, ink is received by the developer roller. In operation S830, the squeegee roller is selectively moved from a non-contact position to a contact position with the developer roller. In operation S840, received ink on the developer roller is condensed by the squeegee roller. In operation S850, a cleaner roller is selectively moved from a non-contact position to a contact position with the developer roller, in operation S860, remaining ink from the developer roller not transferred to the photosensitive drum is removed. In operation S870, a cap member is moved to an uncover position in which the cap member uncovers an exposed portion of the developer roller opposite the photosensitive drum. In one embodiment, in operation S880, the photosensitive drum is selectively engaged by the developer roller.

The present general inventive concept has been described using non-limiting detailed descriptions of embodiments thereof that are provided by way of example and are not intended to limit the scope of the present general inventive concept. It should be understood that features and/or operations described with respect to one embodiment may be used with other embodiments and that not all embodiments of the present general inventive concept have all of the features and/or operations illustrated in a particular figure or described with respect to one of the embodiments. Variations of embodiments described will occur to persons of the art.

It is noted that some of the above described embodiments may describe the best mode contemplated by the inventors and therefore may include structure, acts or details of structures and acts that may not be essential to the present general inventive concept and which are described as examples.

Structure and acts described herein are replaceable by equivalents, which perform the same function, even if the structure or acts are different, as known in the art. Therefore, the scope of the present general inventive concept is limited only by the elements and limitations as used in the claims.

What is claimed is:

1. A developer unit usable with a liquid electrophotographic printing apparatus having a photosensitive drum, the developer unit comprising:

a developer roller to receive ink, and to selectively engage and rotatably transfer the ink to the photosensitive drum, the developer roller to switch between a contact mode in contact with the photosensitive drum and a non-contact mode out of contact with the photosensitive drum;

a squeegee roller to selectively contact the developer roller, the squeegee roller to at least condense the received ink on the developer roller in the contact mode, and to be apart from the developer roller in the non-contact mode; and a cleaner roller to selectively contact the developer roller, the cleaner roller to remove remaining ink from the developer roller not transferred to the photosensitive drum in the contact mode, and to be apart from the developer roller in the non-contact mode;

a cap member to move between a cover position to cover an exposed portion of the developer roller opposite the photosensitive drum and an uncover position to uncover the exposed portion of the developer roller; and a linkage unit coupled to at least one of the squeegee roller and the cleaner roller, the linkage unit to move the cap member between the cover position and the uncover position, wherein, in response to a rotational state of the developer roller, at least one of the squeegee roller, the cleaner roller and the developer roller are to move between the contact mode and the non-contact mode, and the cap member is to move between the cover position and the uncover position.

2. The developer unit according to claim 1, wherein the linkage unit is coupled to both the squeegee roller and the cleaner roller, and includes an engagement portion to engage a contact portion of the cap member to rotate the cap member between the cover position and the uncover position.

3. The developer unit according to claim 1, wherein the cap member is in the uncover position when the rotational state of the developer roller is active and the cap member is in the cover position when the rotational state of the developer roller is inactive.

4. The developer unit according to claim 1, further comprising:

a housing removably mounted to the liquid electrophotographic printing apparatus, wherein at least one of the developer roller, the squeegee roller, the cleaner roller and the cap member are moveably coupled to the housing.

5. The developer unit according to claim 4, wherein the squeegee roller and the cleaner roller are moveably coupled to the housing.

6. The developer unit according to claim 1, wherein the squeegee roller and the cleaner roller move at least one of toward and away from the developer roller.

7. The developer unit according to claim 4, wherein the developer roller is moveably coupled to the housing.

8. The developer unit according to claim 1, wherein the developer roller moves at least one of toward and away from the squeegee roller and the cleaner roller.

9. The developer unit according to claim 1, wherein the cap member is moveably coupled to the developer roller.

10. The developer unit according to claim 1, wherein, in response to the rotational state of the developer roller, each of the squeegee roller and the cleaner roller simultaneously move between the contact mode and the non-contact mode and the cap member moves between the cover position and the uncover position.

11. The developer unit according to claim 1, wherein, in response to the rotational state of the developer roller, each of the developer roller and the cap member simultaneously move between the contact mode and the non-contact mode.

12. A developer unit usable with a liquid electrophotographic printing apparatus having a photosensitive drum, the developer unit comprising:

a developer roller to receive ink, and to selectively engage and rotatably transfer the ink to the photosensitive drum, the developer roller having a contact mode and a non-contact mode;

a squeegee roller to selectively contact the developer roller, the squeegee roller to at least condense the received ink on the developer roller in the contact mode, and to be apart from the developer roller in the non-contact mode;

a cleaner roller to selectively contact the developer roller, the cleaner roller to remove remaining ink from the developer roller not transferred to the photosensitive drum in the contact mode, and to be apart from the developer roller in the non-contact mode;

a cap member to move between a cover position to cover an exposed portion of the developer roller opposite the photosensitive drum and an uncover position to uncover the exposed portion of the developer roller;

a linkage unit coupled to at least one of the squeegee roller and the cleaner roller, the linkage unit to move the cap member between the cover position and the uncover position; and a housing removably coupled to the liquid electrophotographic printing apparatus, wherein the linkage unit and at least one of the developer roller, the squeegee roller, the cleaner roller and the cap member are moveably coupled to the housing; and wherein, in response to a rotational state of the developer roller, the cap member is to move between the cover position and the uncover position and the developer roller is to switch between the contact mode and the non-contact mode.

13. The developer unit according to claim 12, wherein:

the cap member moves to the uncover position and the developer roller switches to the contact mode in response to an active rotational state of the developer roller; and the cap member moves to the cover position and the developer roller switches to the non-contact mode in response to an inactive rotational state of the developer roller.

14. The developer unit according to claim 12, wherein each of the developer roller and the cap member simultaneously move between the contact mode and the non-contact mode in response to the rotational state of the developer roller.

15. A method of operating a developer unit usable with a liquid electrophotographic printing apparatus having a photosensitive drum, the method comprising:

inactivating a rotational state of a developer roller configured to receive ink and transfer the ink to the photosensitive drum;

moving a squeegee roller configured to at least condense the received ink on the developer roller and the developer roller apart from each other;

moving a cleaner roller configured to remove remaining ink from the developer roller not transferred to the photosensitive drum and the developer roller apart from each other; and moving a cap member to a cover position in which the cap member covers an exposed portion of the developer roller opposite the photosensitive drum in response to the inactive rotational state of the developer roller, wherein moving the cap member includes rotating the cap member by engaging a contact portion of the cap member with an engagement portion of a linkage unit coupled to both the squeegee roller and the cleaner roller.

* * * * *